US005992990A

United States Patent [19]

Childers et al.

[11] Patent Number: 5,992,990

[45] **Date of Patent: *Nov. 30, 1999**

[54] INK DELIVERY SYSTEM HAVING AN OFF-CARRIAGE PRESSURE REGULATOR

[75] Inventors: Winthrop D. Childers, San Diego, Calif.; Norman E. Pawlowski, Jr., Corvallis, Oreg.

[73] Assignee: Hewlett-Packard Company, Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/736,106

[22] Filed: Oct. 24, 1996

[51] Int. Cl.[6] ..... B41J 2/175

[52] U.S. Cl. ..... 347/87; 347/94

[58] Field of Search ..... 347/17, 84, 85, 347/86, 87, 94

[56] References Cited

U.S. PATENT DOCUMENTS

| | | | |
|---|---|---|---|
| 3,342,042 | 9/1967 | Sheek et al. | 66/108 |
| 3,371,350 | 2/1968 | Sanderson et al. . | |
| 4,323,907 | 4/1982 | Italiano . | |
| 4,432,005 | 2/1984 | Duffield et al. . | |
| 4,476,472 | 10/1984 | Alba et al. | 347/86 |
| 4,514,742 | 4/1985 | Suga et al. | 347/85 |
| 4,575,738 | 3/1986 | Sheufelt et al. . | |
| 4,700,205 | 10/1987 | Rich et al. | 347/85 |
| 4,734,711 | 3/1988 | Piatt et al. | 346/75 |
| 4,977,413 | 12/1990 | Yamanaka et al. . | |
| 5,021,809 | 6/1991 | Abe et al. . | |
| 5,367,328 | 11/1994 | Erickson | 347/85 |
| 5,488,400 | 1/1996 | Crystal et al. | 347/85 |
| 5,650,811 | 7/1997 | Seccombe et al. | 347/85 |
| 5,686,947 | 11/1997 | Murray et al. | 347/85 |
| 5,719,609 | 2/1998 | Hauck et al. | 347/85 |

FOREIGN PATENT DOCUMENTS

| | | | |
|---|---|---|---|
| 59-042964 | 3/1984 | Japan . | |
| 59-194854 | 11/1984 | Japan . | |
| 2-172753 | 7/1990 | Japan | 347/29 |

*Primary Examiner*—N. Le
*Assistant Examiner*—Judy Nguyen

[57] ABSTRACT

An ink delivery system of an inkjet printer includes a scanning carriage having an ink interconnect coupled, via a flexible tube, to an ink output of a stationary pressure regulator. An ink input of the pressure regulator is connected, via a tube, to a stationary ink supply having replaceable ink cartridges. A relatively small semi-permanent, but replaceable, or permanent print cartridge contains one or more printheads and one or more ink interconnects, one interconnect for each color ink which is printable by the print cartridge. The print cartridge is inserted in the scanning carriage so as to create a fluid coupling between the printhead and the flexible tube leading to the scanning carriage. In the preferred embodiment, the ink pressure regulator is located proximate to the rest position of the carriage to prevent drooling from the printhead should the printer be tipped to a non-level orientation. To avoid ink pressure spikes due to the momentum of the ink in the flexible ink tube as the carriage scans across the medium, a flexible diaphragm is incorporated in the ink chamber of the print cartridge.

16 Claims, 8 Drawing Sheets

INK DELIVERY SYSTEM HAVING AN OFF-CARRIAGE PRESSURE REGULATOR

FIELD OF THE INVENTION

This invention relates to inkjet printers and more particularly to an ink delivery system for an inkjet printer which supplies ink from an ink source to a printhead.

BACKGROUND OF THE INVENTION

Inkjet printers are well-known. In these types of printers, droplets of ink are ejected from orifices in a printhead as the printhead scans across a medium. In certain types of inkjet printers, disposable print cartridges, each containing a printhead and a supply of ink, are installed in a scanning carriage. When the supply of ink is depleted, the print cartridge is disposed of. This results in a fairly expensive cost per sheet of printing.

Another type of inkjet printer allows the user to replace the ink supply in the scanning carriage without disposing of the printhead itself. In both of the cases described above, the scanning carriage supports the ink supply for the printhead. Since the capacity of the ink container must be fairly large to avoid changing ink supplies frequently, the carriage must be fairly large. This large carriage places a limit on reducing the size of the inkjet printer.

To overcome the disadvantages of the "on-axis" ink supplies, printers with off-axis ink supplies have been developed which use an ink supply not carried on the scanning carriage. A flexible tube connects the off-axis ink supply to the scanning printhead. One problem with these off-axis ink delivery systems is that the height difference between the printhead and the ink supply is directly related to the ink pressure to the printhead. Therefore, there is a high likelihood that ink will drool out of the printhead nozzles if the printer is tilted or tipped over. Further, the momentum of the ink in the flexible tube as the carriage scans causes fluctuations in the pressure of the ink applied to the printhead.

What is needed is an ink delivery system for an inkjet printer which does not suffer from the various drawbacks of the existing inkjet printers described above.

SUMMARY

In the preferred embodiment of an inkjet printer, an ink delivery system includes a scanning carriage having an ink interconnect coupled, via a flexible tube, to an ink output of a stationary pressure regulator. An ink input of the pressure regulator is connected, via a tube, to a stationary ink supply having replaceable ink cartridges. A relatively small semi-permanent, but replaceable, or permanent print cartridge contains one or more printheads and one or more ink interconnects, one interconnect for each color ink which is printable by the print cartridge. The print cartridge is inserted in the scanning carriage so as to create a fluid coupling between the printhead and the flexible tube leading to the scanning carriage. Since the printhead receives ink from the stationary ink supply, the print cartridge does not need a large internal ink chamber and the print cartridge and carriage can be made small.

In the preferred embodiment, the ink pressure regulator is located proximate to the rest position of the carriage. This prevents drooling from the printhead should the printer be tipped to a non-level orientation. To avoid ink pressure spikes due to the momentum of the ink in the flexible ink tube as the carriage scans across the medium, a flexible diaphragm is incorporated in the ink chamber of the print cartridge.

A variety of pressure regulators are described, and a variety of print cartridges are described. In a preferred embodiment, since it is desirable to reduce the size of the carriage, each print cartridge has a dual chamber for containing two different colors of ink, so that only two print cartridges are needed for a full color printer printing black, cyan, magenta, and yellow inks.

DETAILED DESCRIPTION OF THE PREFERRED EMBODIMENTS

Figure 1:
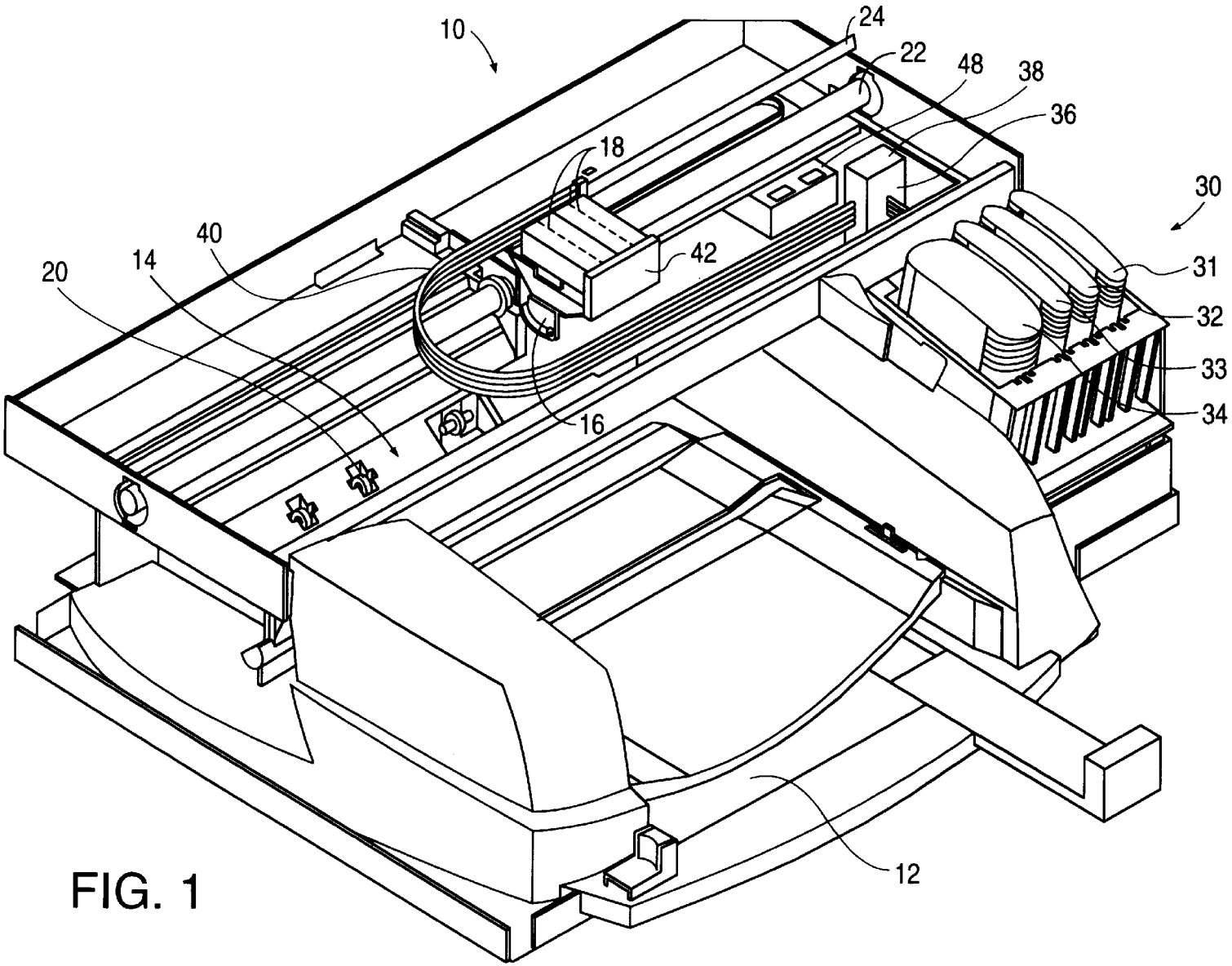
FIG. 1 is a perspective view of an inkjet printer incorporating an off-axis regulator.

FIG. 1 is a perspective view of one embodiment of an inkjet printer 10, with its cover removed, incorporating various inventive features. Generally, printer 10 includes a tray 12 for holding virgin paper. When a printing operation is initiated, a sheet of paper from tray 12 is fed into printer 10 using a sheet feeder, then brought around in a U direction to then travel in the opposite direction (defining a media path and a media axis) toward tray 12. The sheet is stopped in a print zone 14, and a scanning carriage 16, containing one or more print cartridges 18, is then scanned across the sheet for printing a swath of ink thereon.

After a single scan or multiple scans, the sheet is then incrementally shifted using a conventional stepper motor and feed rollers 20 to a next position within print zone 14, and carriage 16 again scans across the sheet for printing a next swath of ink. When the printing on the sheet is complete, the sheet is forwarded to a position above tray 12, held in that position to ensure the ink is dry, and then released.

Alternative embodiment printers include those with an output tray located at the back of printer 10, where the sheet of paper is fed through the print zone 14 without being fed back in a U direction.

The carriage 16 scanning mechanism may be conventional and generally includes a slide rod 22, (defining a carriage path and a carriage axis), along which carriage 16 slides, and a coded strip 24 which is optically detected by a photodetector in carriage 16 for precisely positioning carriage 16. A stepper motor (not shown), connected to carriage 16 using a conventional drive belt and pulley arrangement, is used for transporting carriage 16 across print zone 14.

The novel features of inkjet printer 10 and the other inkjet printers described in this specification relate to the ink delivery system for providing ink to the print cartridges 18 and ultimately to the ink ejection chambers in the printheads. This ink delivery system includes an off-axis ink supply station 30 containing replaceable ink supply cartridges 31, 32, 33, and 34, which may be pressurized or at atmospheric pressure. For color printers, there will typically be a separate ink supply cartridge for black ink, yellow ink, magenta ink, and cyan ink.

Four tubes 36, which may be flexible or rigid, carry ink from the four replaceable ink supply cartridges 31–34 to four pressure regulators within regulator housing 38. The regulators convert the unregulated ink pressure from ink supply cartridges 31–34 to a regulated ink pressure. The regulated ink pressure will typically be set to between approximately −2 to −10 inches of water (−498 to −2491 $N/m^2$), depending on the printhead and other factors. In one embodiment, the printhead prints at a resolution between 300 and 600 dots per inch. Future printheads that offer higher resolution may require pressure setpoints in the range of −10 to −25 inches of water (−2491 to −6227 $N/m^2$) The regulator pressure is also selected to support the ink path and mating architecture. The disclosed regulation system will accommodate all such pressure ranges.

The ink within ink supply cartridges 31–34 may be pressurized or non-pressurized. Additional detail of one embodiment of ink supply cartridges 31–34 is found in U.S. application Ser. No. 08/429,915, filed Apr. 27, 1995, entitled "Ink Supply for an Ink-Jet Printer," by James Cameron et al., attorney docket no. 1094053-2, incorporated herein by reference.

Four flexible tubes 40 are connected from the outlets of the regulators in housing 38 to a manifold 42 on the carriage 16.

Various embodiments of the off-axis ink supply, the regulators, the scanning carriage, and the print cartridges will be described herein.

Figure 2:
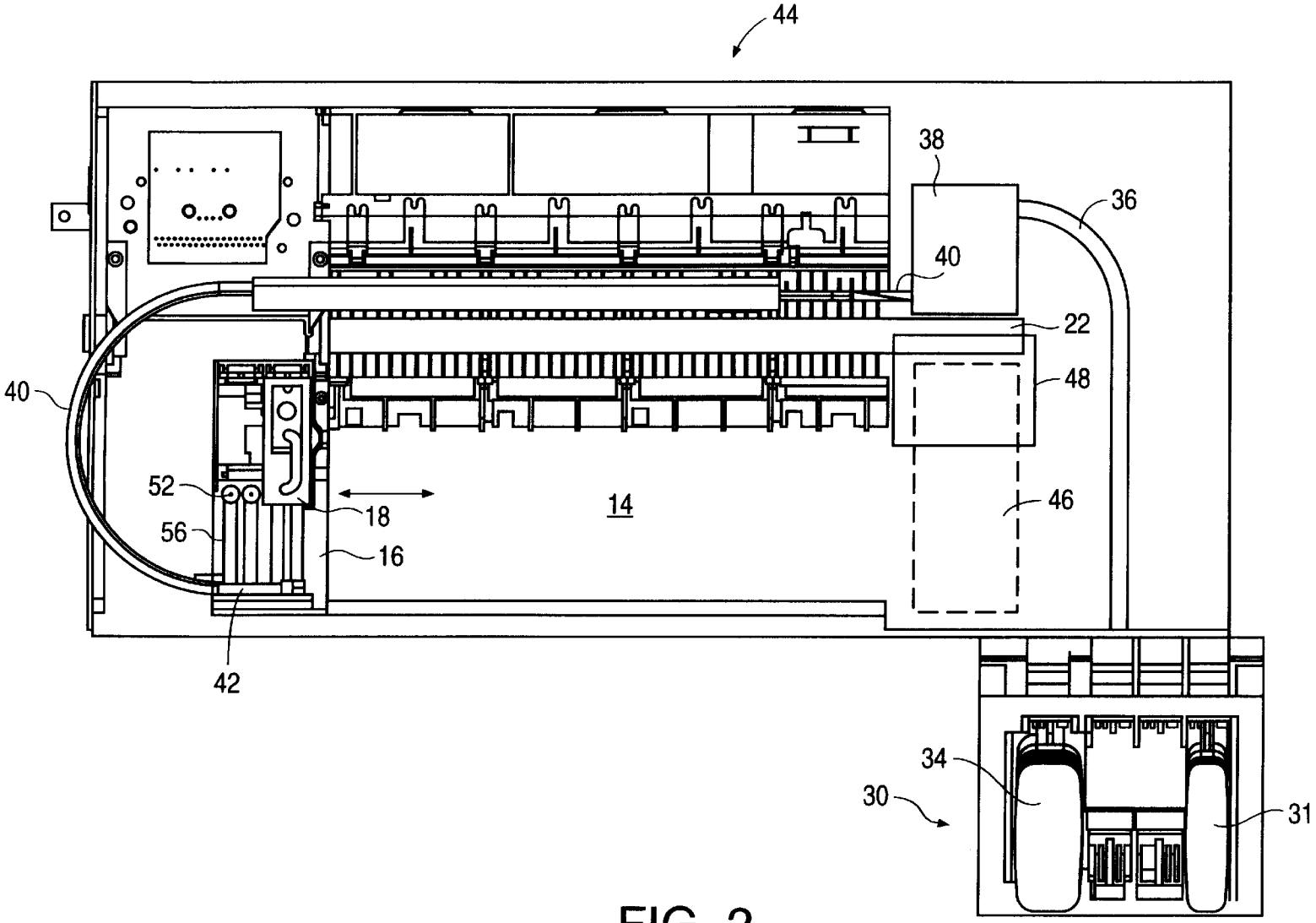
FIG. 2 is a top down view of an alternative embodiment inkjet printer having one print cartridge installed and incorporating an off-axis regulator.

FIG. 2 is a top down view of another printer 44 very similar to that shown in FIG. 1, but with the paper tray removed and one print cartridge 18 removed. Elements throughout the various figures identified with the same numerals may be identical.

In a preferred embodiment, the regulators in housing 38 are located as close as practical to the rest position 46 (FIG. 2) of carriage 16. This will be proximate to the service station 48, which performs functions such as priming the printheads and cleaning the nozzle plates of the printheads. This location of the regulators minimizes the distance between the rest position of the printhead nozzles and the pressure regulators. This proximity is not critical when the printer is flat. However, when the printer is tilted, the height difference between the pressure regulator and the nozzles will vary. If the regulator is moved a sufficient distance above the nozzles, then drooling will take place. By reducing this distance below a critical value, such drooling is prevented. This is best described by a formula, as presented below.

$P_p$=gauge pressure setpoint within a pen printhead. Gauge pressure is equal to the absolute pressure minus absolute atmospheric pressure. In the preferred embodiment, the gauge pressure setpoint is −4.5 inches of water (−1121 $N/m^2$).

$H_o$=height of regulator minus height of printhead when printer is flat. Assume that the regulator is designed to be located 1 inch above the printheads when the printer is flat.

$P_r$=gauge pressure setpoint of regulator=$P_p-H_o$. In our example, the regulator setpoint would be −5.5 inches of water (−1370 $N/m^2$) to compensate for the height of the regulator above the printhead during normal operation.

$\Delta P$=pressure variation expected among regulators.

In the above example, the regulator pressure can vary by ±1.5 inches of water (±374 $N/m^2$) due to a normal worst-case tolerance variation. Thus, under worst-case conditions, the regulator pressure can be as high as −4 inches of water (−996 $N/m^2$). To avoid ink drool, the regulator can never be more than 4 inches above the printhead. Therefore, we must locate the regulator within 4 inches of the printhead to avoid drooling when the product is tilted to its worst-case drool-inducing orientation, which would typically be when the printer is placed on its side with the regulator above the printhead.

Thus, we have the following formula:

$$D_{max}=P_p(\text{in inches of water})-H_o-\Delta P,$$

where $D_{max}$=maximum safe distance (in inches) between the rest position of the printhead and the regulator.

Each of the regulators in housing 38 essentially consists of a valve controlling an opening between the inlet and outlet of the regulator. The valve opens in response to an ink pressure drop on the outlet side of the regulator and closes in response to an ink pressure increase on the outlet side. The desired ink pressure at the outlet side is a predetermined difference between the pressure on the outlet side and ambient (atmospheric) pressure. A typical negative regulated pressure could be approximately −4 inches of water (−996 $N/m^2$). As an example, when it is sensed that the ink pressure at the outlet side reaches a threshold of, for example, −5 inches of water (−1245 $N/m^2$), the valve opens until the pressure has reached, for example, −3 inches of water (−747 $N/m^2$), which then automatically closes the valve. With smaller nozzle diameters, the optimum ink pressure is increasingly negative. Thus, threshold pressures of −10 inches of water (−2491 $N/m^2$) or even more negative may be feasible.

When printer 10 or 44 is not being operated, the valve in each regulator will be closed. Additional details of the regulators will be described with respect to FIGS. 8–10.

Figure 3:
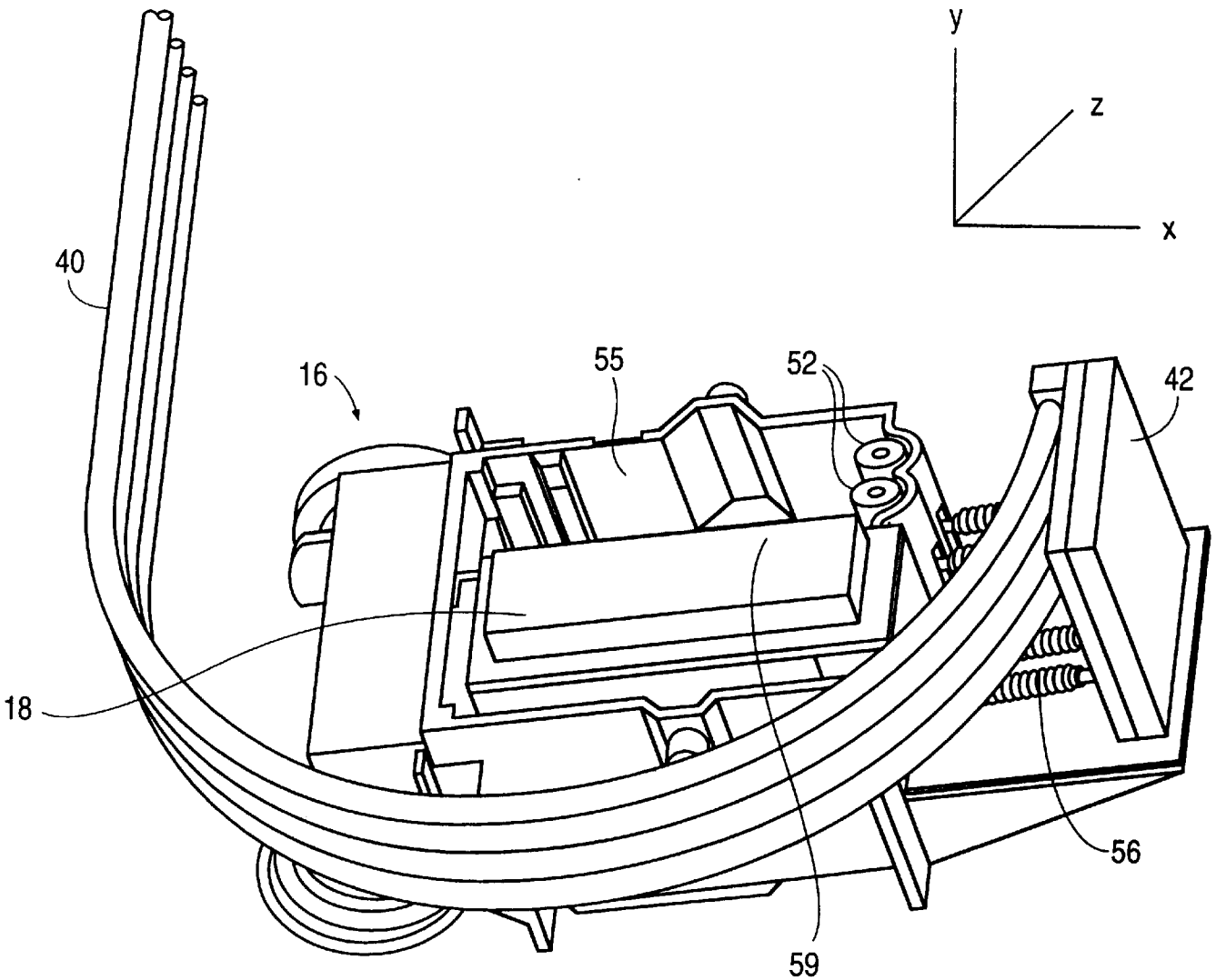
FIG. 3 is a perspective view of one embodiment of the scanning carriage.

In FIGS. 2 and 3, a single print cartridge 18 is shown installed in carriage 16. Four tubes 40, each connected to an outlet of a pressure regulator, are in fluid communication with a rubber septum 52 supported by carriage 16. A hollow needle 54 (FIG. 4), formed as part of each print cartridge 18, is inserted through the rubber septum 52 upon pushing the print cartridge 18 into its associated stall 55 (FIG. 3) within carriage 16 so that a fluid communication path exists between a particular ink supply cartridge 31–34 and a particular print cartridge printhead for providing a supply of ink to the printhead.

A flexible bellows 56 (FIG. 3) is provided for each rigid septum elbow 58 (FIG. 4) for allowing a degree of x, y, and z movement of septum elbow 58 when needle 54 is inserted into septum 52 to minimize the x, y, and z load on needle 54 and ensure a fluid-tight and air-tight seal around needle 54. Bellows 56 may be formed of butyl rubber, high acn nitrile, latex, or other flexible material with low vapor and air transmission properties. In one embodiment, bellows 56 is a flexible diaphragm which is circular or rectangular in shape and may consist of a piece of film forming, or backed by, a resilient member. Alternatively, bellows 56 can be replaced with a U-shaped or circular flexible tube.

A spring (not shown) urges septum 52 upward. This allows septum 52 to take up z tolerances, minimizes the load on needle 54, and ensures a tight seal around needle 54.

An ink channel 59 extends from each needle 54, over the top of print cartridge 18, and into an ink chamber.

Additional detail regarding the ink interconnect is found in U.S. application Ser. No. 08/706,062, filed Aug. 30, 1996, entitled "Inkjet Printer With Off-Axis Ink Supply," by Norman Pawlowski, Jr., et al., attorney docket no. 10960163-1, incorporated herein by reference.

Figure 4:
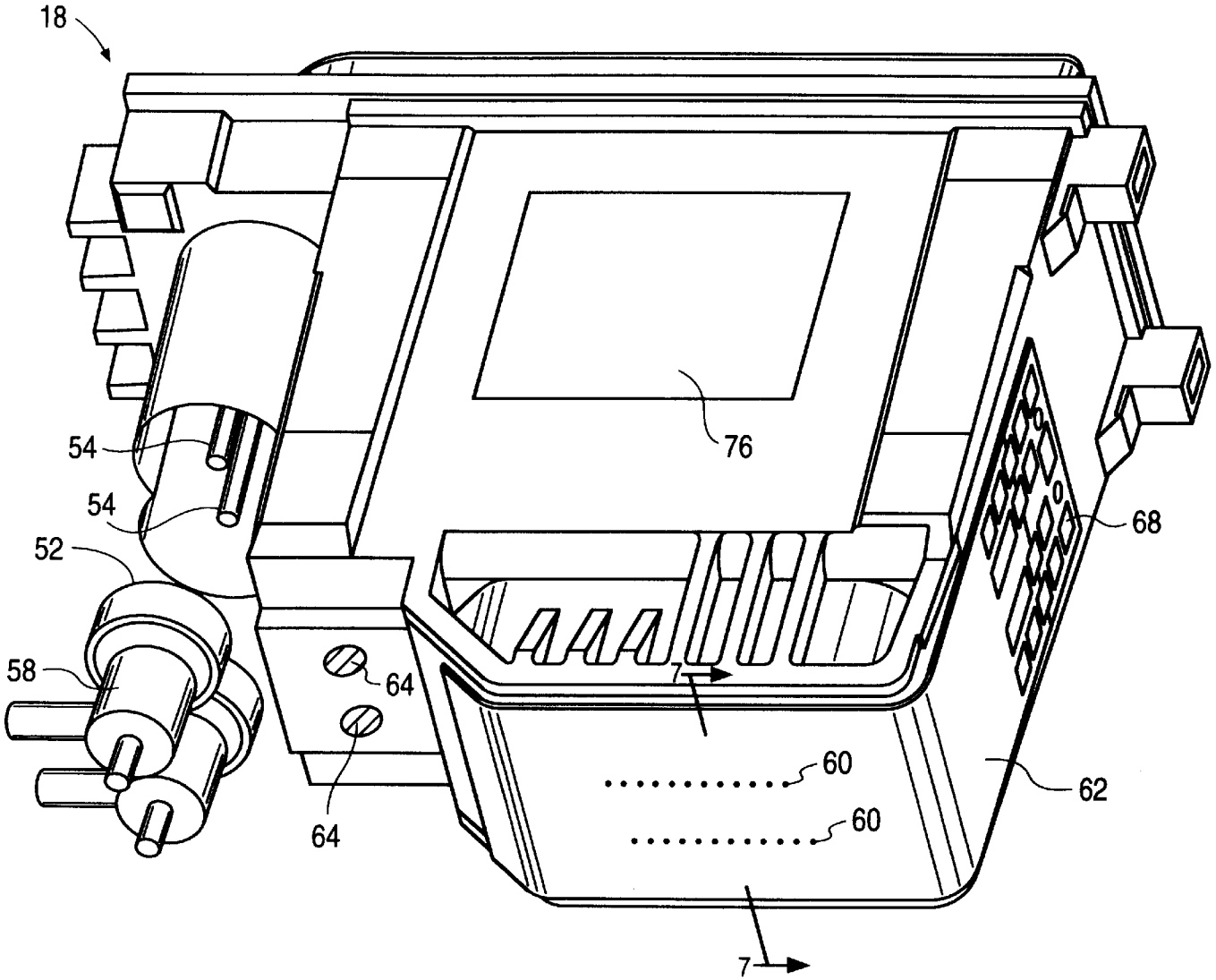
FIG. 4 is a perspective view of one embodiment of the print cartridge and its ink interconnect.

FIG. 4 illustrates the bottom side of a multi-chamber print cartridge 18. Two parallel rows of offset nozzles 60, one row for each color ink printed by print cartridge 18, are shown laser ablated through tape 62. In one embodiment, there are 300 nozzles spaced to print a vertical resolution of 600 dots per inch. Ink fill holes 64 are used to initially fill the print cartridge ink chambers with ink. Stoppers (not shown) are intended to permanently seal holes 64 after the initial filling.

Metal contact pads 68 are electrically connected to electrodes on a substrate carrying the ink ejection elements.

Figure 5:
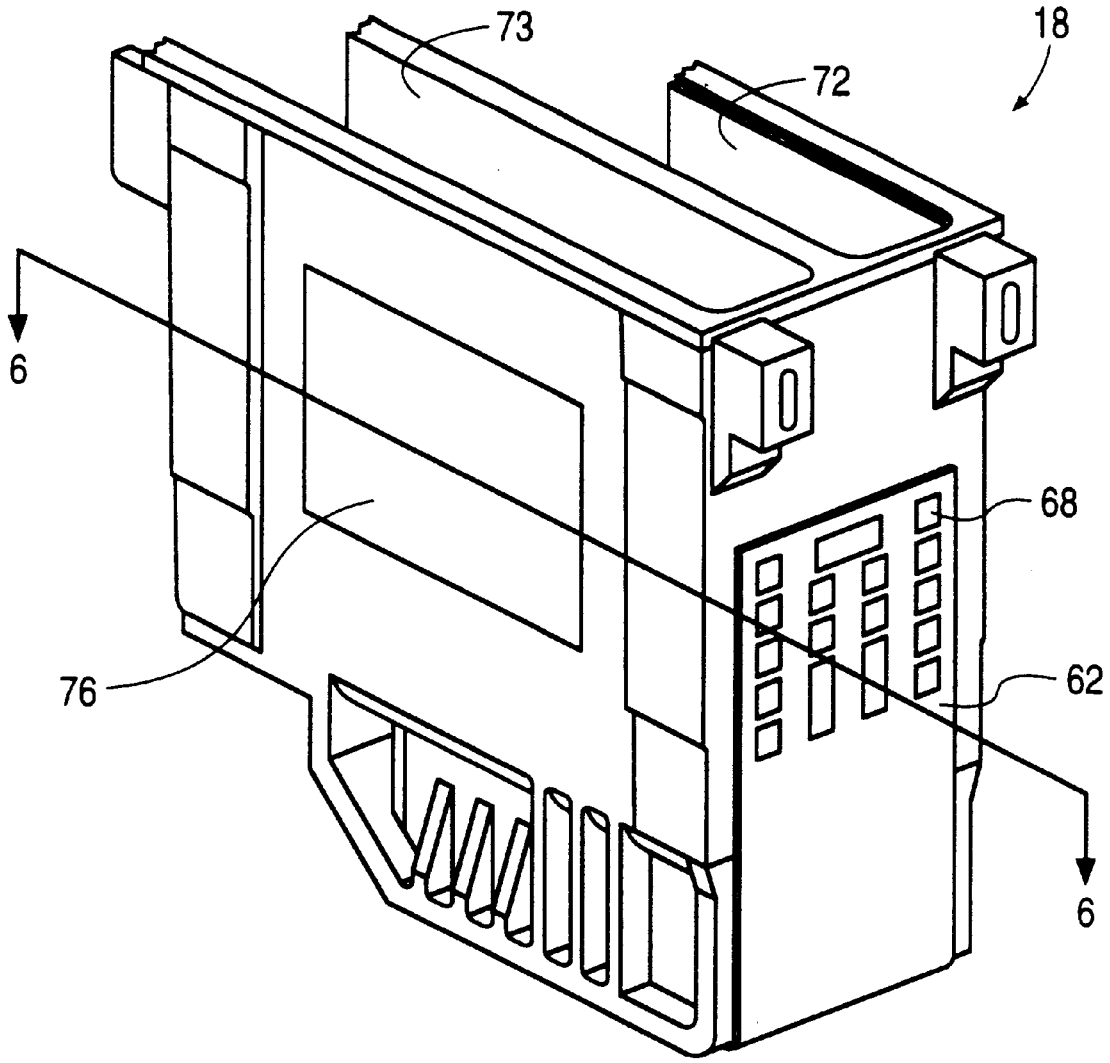
FIG. 5 is a perspective view of the print cartridge of FIG. 4 showing its dual chambers.

FIG. 5 shows print cartridge 18 with its top removed to illustrate two ink chambers 72 and 73, each for a particular color ink. Each ink chamber 72, 73 is in fluid communication with a respective needle 54 (FIG. 4) and an associated ink supply cartridge 31–34 via the tubing and ink interconnects, previously described. Each chamber 72, 73 is in fluid communication with a portion of a single printhead, or a separate printhead, associated with that chamber.

To mitigate the effects of ink pressure spikes due to the acceleration and deceleration of the scanning carriage 16, a wall of each of the chambers 72, 73 has a flexible (e.g., rubber) portion identified as diaphragm 76. Diaphragm 76 flexes outward a slight amount with an ink pressure spike to absorb any pressure increase of the incoming ink. Conversely, diaphragm 76 flexes inwardly into the ink chamber 72, 73 to absorb a negative pressure spike in the ink. The characteristics of diaphragm 76 would typically be empirically determined based upon the particular characteristics of the ink printer, taking into account scanning acceleration, the size of the flexible tubes 40, the size of the ink chambers, and other factors.

Figure 6:
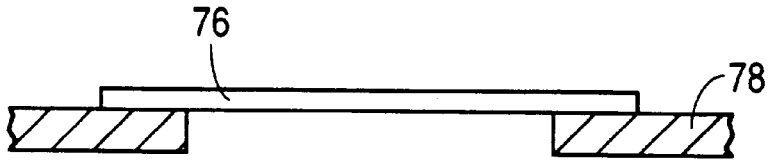
FIG. 6 is a cross-sectional view along line 6—6 in FIG. 5 illustrating a flexible diaphragm in a wall of an ink chamber for reducing ink pressure spikes.

FIG. 6 is a cross-sectional view along line 6—6 in FIG. 5 of the flexible diaphragm 76 which is adhesively secured or compression clamped to the plastic print cartridge frame 78. In one embodiment diaphragm 76 has an area of about 1 $cm^2$ and is about 0.5 mm thick. The area and thickness depends on the flexibility of the material and the particular requirements of the system.

Figure 7:
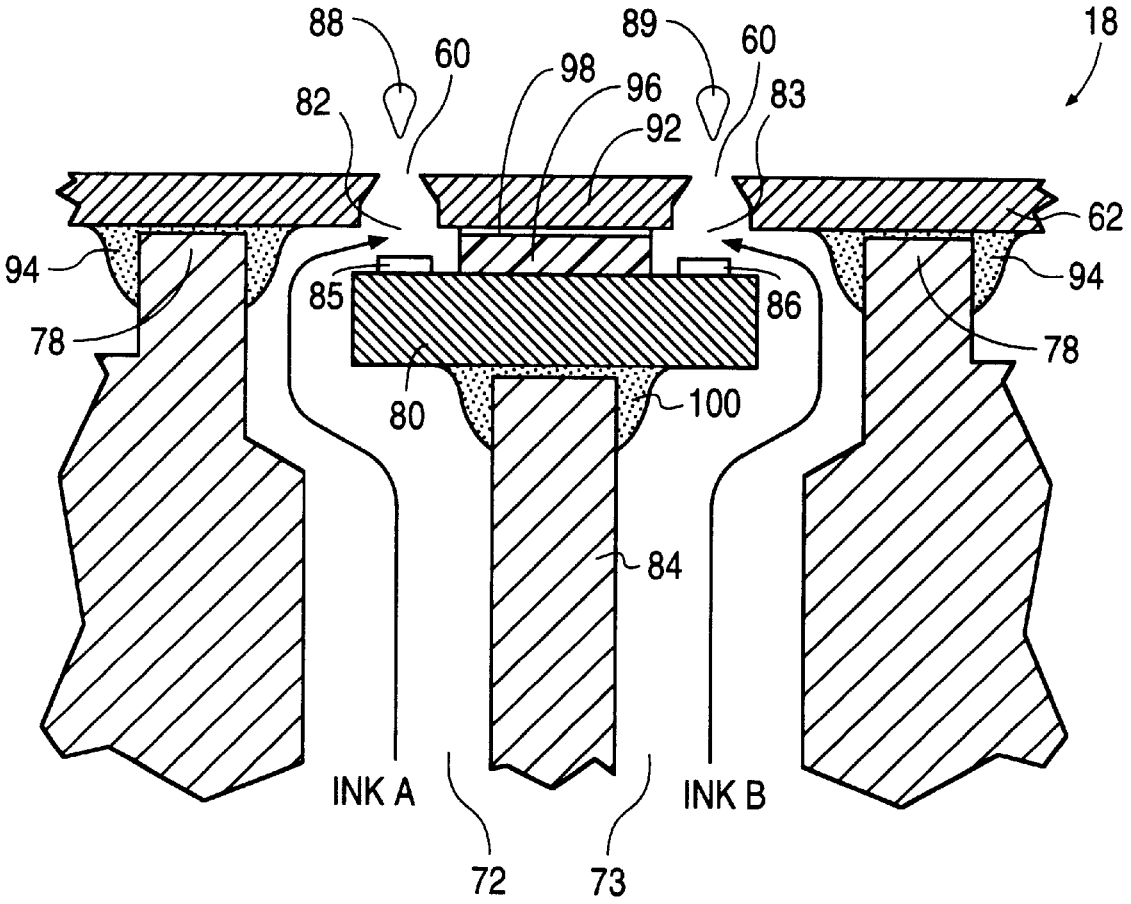
FIG. 7 is a cross-sectional view along line 7—7 in FIG. 4 illustrating the flow of ink around the edges of the printhead substrate to the ink ejection chambers.

FIG. 7 is a cross-sectional view along line 7—7 in FIG. 4 illustrating the paths of inks A and B in the dual chambers 72, 73 around the outer edges of the silicon substrate 80 and into ink ejection chambers 82, 83. A center wall 84 separates the two chambers. A heater resistor 85, 86 in each of the ink ejection chambers is selectively energized to eject a droplet 88, 89 of ink from an associated nozzle 60. Additional detail of a printhead which may be modified to have the characteristics of FIG. 7 is described in U.S. Pat. No. 5,278,584, by Keefe et al., incorporated herein by reference.

In the preferred embodiment, the nozzle member 92 is a flexible tape 62, such as Kapton™, having the nozzles 60 laser ablated through the flexible tape 62. Contact pads 68 (FIG. 4) formed on the flexible tape 62 are connected to conductive traces on the back of the tape 62. The other ends of the traces are connected to electrodes on the substrate 80, which are ultimately connected to the heater resistors 85, 86. In another embodiment, piezoelectric elements are used instead of heater resistors. The tape 62 is secured to the print cartridge frame 78 by an adhesive 94. A barrier layer 96 forming the ink ejection chambers 82, 83 may be formed of a photoresist. An adhesive layer 98 secures the barrier layer 96 to the bottom of the flexible tape 62. An adhesive 100 affixes substrate 80 to the center wall 84 and creates an ink seal between the chambers 72, 73.

Although using two dual chamber print cartridges 18 has been shown in the preferred embodiment to reduce the size of the scanning carriage 16, four single chamber print cartridges (without wall 84) can also be used. U.S. Pat. No. 5,278,584 by Keefe et al. shows a print cartridge for printing a single color. A smaller version of that print cartridge, but incorporating an ink inlet port, may be used in the printer of the present invention such that four print cartridges are used instead of two. FIG. 1 of the present disclosure illustrates the four print cartridges by dashed lines. Alternatively, a single black ink print cartridge and a tri-color print cartridge may be used, where the tri-color print cartridge incorporates three sets of nozzles, one for each color.

Figure 8:
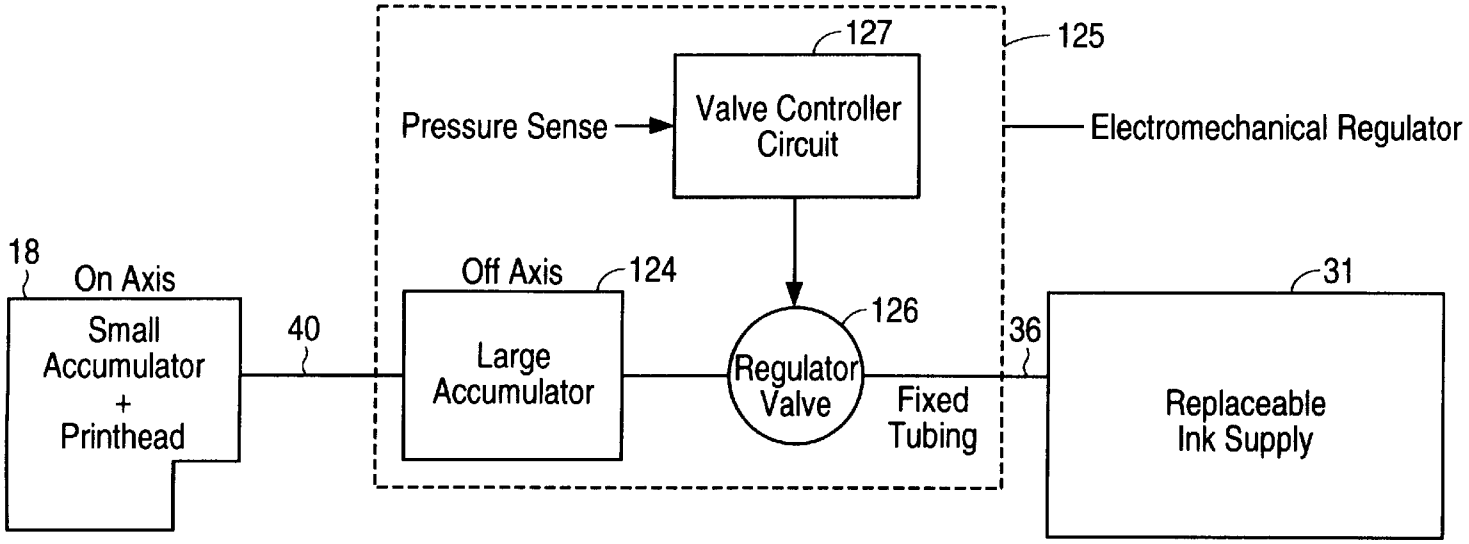
FIG. 8 is a diagram of one embodiment of an ink delivery system.
Figure 9:
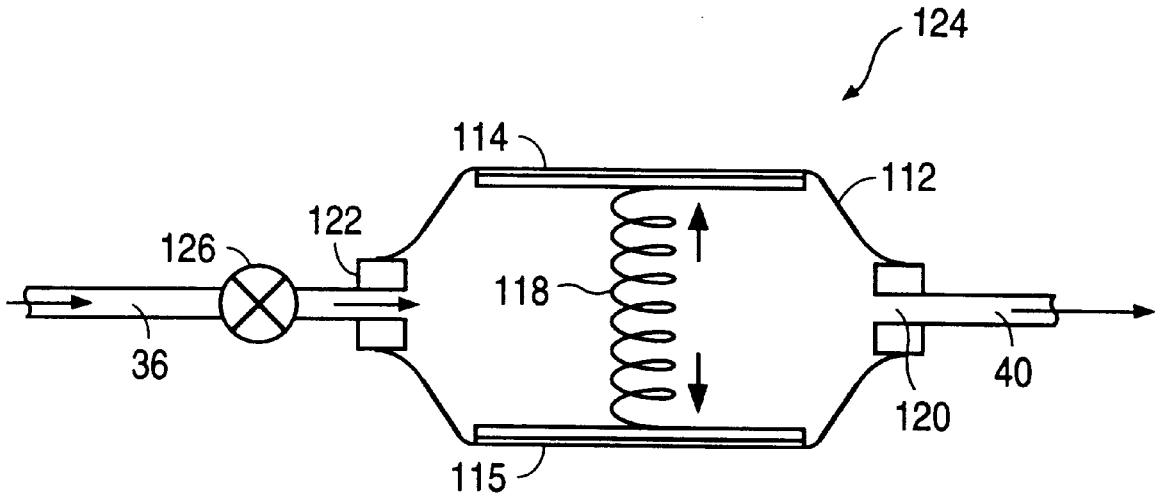
FIG. 9 is a cross-sectional view of an ink accumulator which may be used in the embodiment of FIG. 8.

FIG. 8 is a diagram of an ink delivery system in accordance with one embodiment of the invention. In FIG. 8, the print cartridge 18 includes a single ink chamber or a dual ink chamber. Only one ink color path is shown for simplicity, and there will be a separate ink delivery system for each color ink.

Internal to each ink chamber in the print cartridge 18 is a relatively small accumulator of ink. The purpose of the small accumulator is to absorb carriage motion-induced pressure spikes. This accumulator, in one embodiment, consists of the flexible diaphragm 76 in FIGS. 5 and 6 forming a wall of the ink chamber. Another type of accumulator that may be housed in a print cartridge is similar to the accumulator 124 shown in FIG. 9 and may hold anywhere from a few cubic centimeters of ink to a few tens of cubic centimeters of ink, depending upon the tolerable size of the print cartridge 18. In one embodiment, the accumulator 124 shown in FIG. 9 comprises an ink bag 112 whose side walls 114, 115 are urged outward by an internal spring 118 so as to provide a negative pressure at an outlet 120, opening into chamber 72 or 73. Such a negative pressure will typically be on the order of −2 inches of water to −10 inches of water, depending upon the characteristics of the printhead. An inlet 122 receives the ink.

Referring to FIG. 8, ink is delivered to print cartridge 18 via flexible tubing 40, which is preferably Polyvinylidene Chloride (PVDC), sold under the trade name Saran™ by DuPont. The flexible tubing 40 is connected to the output of a larger accumulator 124, forming part of a regulator 125, inside the regulator housing 38 (FIGS. 1 and 2). The accumulator 124 provides tolerance to air bubbles and allows for accurate pressure regulation of the ink from ink supply 31. The large accumulator 124 is connected to the fixed tubing 36, leading from the replaceable ink supply cartridge 31, by the regulator valve 126. The regulator valve 126 may be any form of valve, such as a rotary valve or a flapper valve.

In the preferred embodiment, the regulator valve 126 is a flapper valve which covers and uncovers a hole between the inlet 122 of the large accumulator 124 and the tube 36 to selectively allow an amount of ink to flow from the replaceable ink supply 31 to the large accumulator 124. The opening and closing of the valve 126 is dependent upon the ink pressure at the outlet 120 of the large accumulator 124. Such ink pressure may be determined by a diaphragm or, in the preferred embodiment, by monitoring the physical dimensions of the accumulator 124 of FIG. 9. As the printhead ejects ink, the large accumulator 124 collapses. When the accumulator 124 collapses to a certain point, a position sensor connected to a sidewall 114 of the ink bag 112 triggers a controller circuit that opens the valve 126.

This position sensor may simply be a flag attached to the sidewall 114 of the accumulator 124 which interrupts a path between a photodetector and a LED when the ink bag 112 collapses to a certain point. While the valve 126 is opened, the accumulator 124 back pressure draws in a controlled amount of ink from ink supply 31, determined by the open time of valve 126 and the flow rate of the ink. Since the collapsing of the spring 118 is related to the negative pressure at the outlet 120 of the accumulator 124, actuating the valve 126 based upon the collapsing of the ink bag maintains the negative pressure at the outlet 120 at a fairly constant level.

Another method of sensing the collapse of the ink bag 112 is by positioning a metal leaf spring above or below the ink bag 112 which contacts a conductor. When the ink bag 112 collapses, the leaf spring loses contact with the conductor, signalling that it is time to open the valve 126 to refill the accumulator 124. Other methods of sensing include capacitive sensing and inductive sensing.

Instead of sensing the physical collapsing of the ink bag 112, the back pressure at the outlet 120 of the accumulator 124 can be sensed using a conventional pressure transducer at the outlet 120.

The various means of sensing pressure are identified as the valve controller circuit 127 in FIG. 8.

In the preferred embodiment, the pressure sensor, whether detecting the collapsing of the ink bag 112 or directly detecting the pressure at the outlet 120 of the accumulator 124, also detects when the ink supply 31 is out of ink. When the system opens the valve 126, the pressure should return to a less negative level, and the accumulator 124 should rebound. If it does not, this is detected, and the system thereby determines that the ink supply 31 is out of ink and the valve 126 should be closed to avoid air entering the tubing 40 and print cartridge 18. Such a determination will also indicate to the printer to give the user an out-of-ink warning.

Figure 10:
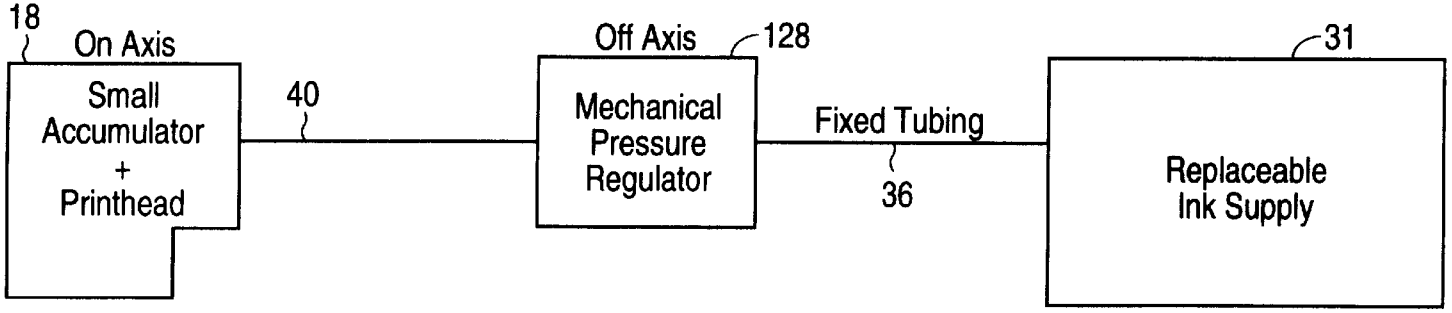
FIG. 10 is a diagram of an alternative embodiment of an ink delivery system.

FIG. 10 illustrates another embodiment ink delivery system for an inkjet printer, where print cartridge 18 is connected via the flexible tubes 40 to a fixed mechanical pressure regulator 128. Such a mechanical pressure regulator 128 may use more conventional techniques than the regulator described with respect to FIG. 8. One such mechanical regulator 128 incorporates a moveable lever, where the position of the lever is based on the difference between atmosphere pressure and the pressure of ink in the regulator. The movement of the lever in response to the pressure differential mechanically opens and closes a valve at an inlet of the regulator (where opening the valve makes the regulator pressure more positive) to maintain the ink pressure at the outlet of the regulator relatively constant. Such a regulator will be well understood by those skilled in art after reading this disclosure. The particular characteristics of the regulator would be adjusted to achieve the desired negative pressure.

One type of mechanical regulator which may be used is similar as that described in U.S. application Ser. No. 08/550,902, filed Oct. 31, 1995, entitled "Apparatus For Providing Ink To An Ink-Jet Print Head And For Compensating For Entrapped Air," by Norman Pawlowski, Jr. et al., attorney docket no. 1094910-1, incorporated herein by reference. Although the regulator described in that application is internal to the print cartridge itself, such a regulator without the printhead could also serve as the fixed regulator in FIG. 8. Another suitable mechanical regulator is described in U.S. application Ser. No. 08/518,847, filed Aug. 24, 1995, entitled "Pressure Regulated Free-Ink Ink-Jet Pen," by Norman Pawlowski, Jr. et al., attorney docket no. 1093486-1, incorporated herein by reference. Another suitable regulator is found in U.S. application Ser. No. 08/705,394, filed Aug. 30, 1996, entitled "An Ink Delivery System for an Inkjet Pen Having an Automatic Pressure Regulator System," by Winthrop Childers, et al., attorney docket no. 10960493-1, incorporated herein by reference.

Accordingly, a number of embodiments of an inkjet printer having a fixed regulator have been described. Placing the regulator at a fixed location off the carriage has two major advantages over having the regulator on board the carriage: 1) it allows the manufacture of very small printers, since the print cartridge size and the carriage size can be reduced; and 2) the regulator can be made more accurate and air-tolerant. By having the regulator off-board, we can increase regulator size, thus increasing the accuracy of the regulator, improving the accumulator capacity, and improving the regulator's tolerance to bubbles.

The regulator and/or ink supply station can be placed on either the forward side (shown in FIG. 1) of the carriage scan path or behind the carriage scan path. Also, the ink supply station can be located virtually anywhere internal or external to the printer, such as on the side opposite to the carriage rest position.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. An ink delivery system for an inkjet printing system, the inkjet printing system including a carriage and a media path, wherein said carriage scans along a carriage scan path that is oriented along a carriage axis, and wherein said media path is oriented along a media axis that is substantially perpendicular to said carriage axis, said ink delivery system comprising:

a fixed ink supply station;

a replaceable ink supply releasably mounted on said fixed ink supply station;

a fixed pressure regulator having an inlet, an outlet, and a regulator valve, said regulator valve being coupled between said inlet and outlet, said inlet being in fluid communication with said ink supply station, wherein said regulator valve automatically opens and closes to maintain a controlled negative pressure relative to ambient pressure at said outlet of said fixed pressure regulator;

a tube coupled to said ink supply station and fixed pressure regulator, said tube consisting of an outer wall having a first end and a second end and defining openings at said first and second ends said first end being coupled to said ink supply station, said second end being coupled to said inlet of said fixed pressure regulator;

a print cartridge body mounted to said carriage, said print cartridge body including a printhead and an ink reservoir containing an amount of ink for ejection by said printhead onto media; and a flexible conduit in fluid communication between said outlet of said pressure regulator and said print cartridge body, wherein the negative pressure at said outlet of said pressure regulator is sufficient to draw ink from said replaceable ink supply and into said pressure regulator when said regulator valve is open.

2. The ink delivery system of claim 1 further comprising a damping element forming a portion of said ink reservoir in fluid communication with said printhead, said damping element reducing ink pressure variations at said printhead that are generated by carriage motion.

3. The ink delivery system of claim 2, wherein said damping element is a flexible member forming a portion of an outer wall of said ink reservoir, said damping element having a reference surface and an internal surface, said reference surface being in communication with an outside atmosphere, and said internal surface being in fluid communication with said ink within said print cartridge body.

4. The ink delivery system of claim 1, wherein said carriage has a rest position when said printing system is idle, said printhead being no more than N inches from said regulator when said carriage is in said rest position, N being equal to the magnitude of a gauge pressure setpoint of said regulator, measured in inches of water, such that tilting of said printing system will not result in a positive pressure of said ink at said printhead.

5. The ink delivery system of claim 1, wherein said carriage has a rest position when said printing system is idle and wherein said printhead has at least one nozzle having a rest position, said rest position of said nozzle being a distance from said regulator such that said printhead will not drool said ink through said nozzle at all orientations of said ink delivery system.

6. The ink delivery system of claim 1, further comprising a printhead service station, said printhead service station located proximate to said regulator, wherein said carriage has a rest position when said printing system is idle, said carriage located proximate to said service station and said regulator when said carriage is in said rest position.

7. The ink delivery system of claim 6, wherein said ink supply station is also located proximate to said service station.

8. The ink delivery system of claim 6, wherein said regulator is located between the carriage scan path and said ink supply station.

9. The ink delivery system of claim 1, wherein said regulator is external to said replaceable ink supply.

10. The ink delivery system of claim 1 wherein said replaceable ink supply has an ink discharge port and further comprising a fixed conduit in fluid connection between said ink discharge port and said inlet of the regulator.

11. The ink delivery system of claim 1 further comprising a second print cartridge body including a second printhead.

12. The ink delivery system of claim 1, wherein said fixed pressure regulator further comprises an accumulator coupled between said regulator valve and said outlet.

13. The ink delivery system of claim 1, wherein said print cartridge body further comprises an accumulator coupled between said ink reservoir and said outlet of said fixed pressure regulator, said accumulator reducing ink pressure variations at said printhead that are generated by carriage motion.

14. A method performed by an inkjet printer comprising:

supplying energization signals to at least one printhead in a scanning carriage, as said scanning carriage scans across a medium, so as to eject droplets of ink from said at least one printhead; and supplying ink to said at least one printhead comprising:

creating a negative pressure in at least one print cartridge body housing said at least one printhead as said at least one printhead ejects said ink droplets onto said medium;

supplying said ink to said at least one print cartridge body through at least one flexible tube in fluid communication between said at least one print cartridge body and a stationary pressure regulator within said printer, said regulator having a regulator valve;

regulating with said regulator a pressure of said ink entering said at least one flexible tube by automatically controlling activation of said regulator valve, such that a pressure of ink leading to said at least one print cartridge body is of a desired negative pressure relative to atmosphere pressure; and supplying said ink to said regulator from at least one removeably mounted ink supply cartridge installed in a fixed ink supply station and through a tube by opening said regulator valve, whereby the negative pressure in said at least one print cartridge body housing draws ink from said at least one removeably mounted ink supply cartridge, through said tube and into said regulator, wherein said tube consists of an outer wall having a first end and a second end and defining openings at said first and second ends, said first end being coupled to said ink supply station, said second end being coupled to said regulator.

15. The method of claim 14, wherein said regulating further comprises varying the pressure within an accumulator internal to said regulator.

16. The method of claim 14, further comprising absorbing pressure variations within said printhead generated caused by movement of said scanning carriage.

* * * * *